US009035985B2

(12) United States Patent
Kato et al.

(10) Patent No.: US 9,035,985 B2
(45) Date of Patent: May 19, 2015

(54) PRINTER APPARATUS AND METHOD FOR OPERATING PRINTER APPARATUS

(71) Applicant: FUJITSU COMPONENT LIMITED, Tokyo (JP)

(72) Inventors: Rintaro Kato, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/226,931

(22) Filed: Mar. 27, 2014

(65) Prior Publication Data

US 2014/0292992 A1 Oct. 2, 2014

(30) Foreign Application Priority Data

Apr. 1, 2013 (JP) ..... 2013-076485

(51) Int. Cl.
*B41J 11/04* (2006.01)
*B41J 15/04* (2006.01)

(52) U.S. Cl.
CPC ..... *B41J 11/04* (2013.01); *B41J 15/042* (2013.01)

(58) Field of Classification Search
CPC ..... B41J 11/04; B41J 11/02; B41J 15/042; B41J 2/325
USPC ..... 347/220
See application file for complete search history.

(56) References Cited

U.S. PATENT DOCUMENTS

| | | | | |
|---|---|---|---|---|
| 6,744,457 | B2 | 6/2004 | Seino et al. | |
| 2001/0001273 | A1 * | 5/2001 | Mori et al. | 400/660 |
| 2006/0221171 | A1 * | 10/2006 | Watanabe et al. | 347/215 |
| 2011/0203467 | A1 | 8/2011 | Naito | |

FOREIGN PATENT DOCUMENTS

| | | |
|---|---|---|
| JP | 07-068866 | 3/1995 |
| JP | 2585769 | 2/1997 |
| JP | 2003-246104 | 9/2003 |

* cited by examiner

*Primary Examiner* — Sarah Al Hashimi
(74) *Attorney, Agent, or Firm* — IPUSA, PLLC

(57) ABSTRACT

A printer apparatus includes a printer body including an opening part that has a protruding part, a support part including a rotary shaft and rotatably attached to the printer body to rotate about the rotary shaft, a platen unit provided in the support part, and a shaft bearing including a projecting part and rotatably supports the platen roller. The opening part receives the shaft bearing. In a state where the platen unit is installed in the printer body, the projecting part and the protruding part contact each other. In a case of removing the platen unit from the printer body, the shaft bearing and the support part rotate in a same direction.

8 Claims, 6 Drawing Sheets

PRINTER APPARATUS AND METHOD FOR OPERATING PRINTER APPARATUS

CROSS-REFERENCE TO RELATED APPLICATIONS

This application is based upon and claims the benefit of priority of the prior Japanese Patent Application No. 2013-076485 filed on Apr. 1, 2013, the entire contents of which are incorporated herein by reference.

FIELD

The embodiments discussed herein are related to a printer apparatus and a method for operating the printer apparatus.

BACKGROUND

A printer apparatus for outputting a receipt or the like is widely used for various purposes such as a cashier terminal of a shop or an ATM (Automated Teller Machine) or a cash dispenser of a bank. For example, a printer apparatus outputs a receipt by printing characters or the like on a recording paper (e.g., heat sensitive paper) with a thermal head while conveying the recording paper until the recording paper reaches a predetermined length, and cutting the recording paper upon reaching the predetermined length.

The printer apparatus includes, for example, a printer body and a cover part rotatably supported by the printer body. By opening the cover part, a roll of recording paper can be placed into the printer body. In this case, for example, a thermal head may be placed in the printer body, and a platen roller may be placed in the cover part. By closing the cover part, the recording paper can be sandwiched between, for example, the thermal head and the platen roller. In this state where the recording paper is sandwiched between the thermal head and the platen roller, printing by the thermal head is performed.

[Patent Document 1]: Japanese Patent No. 2585769

[Patent Document 2]: Japanese Laid-Open Patent Publication No. 7-68866

[Patent Document 3]: Japanese Laid-Open Patent Publication No. 2003-246104

In a case of replacing a recording paper with a printer apparatus that requires opening the cover part after separating the platen roller from the thermal head, the replacement of the recording paper is generally time consuming and inconvenient.

In order to improve convenience of the printer apparatus, a structure allowing the cover part to be easily opened/closed may be provided. However, with this structure, the cover part may accidentally be opened due to shock, vibration or the like and lead to problems during use of the printer apparatus.

SUMMARY

According to an aspect of the invention, there is provided a printer apparatus that includes a printer body including an opening part that has a protruding part, a support part including a rotary shaft and that is rotatably attached to the printer body to rotate about the rotary shaft, a platen unit provided in the support part, and a shaft bearing including a projecting part and that rotatably supports the platen unit. The opening part receives the shaft bearing. In a state where the platen unit is installed in the printer body, the projecting part and the protruding part contact each other. In a case of removing the platen unit from the printer body, the shaft bearing and the support part rotate in a same direction.

The object and advantages of the invention will be realized and attained by means of the elements and combinations particularly pointed out in the claims.

It is to be understood that both the foregoing general description and the followed detailed description are exemplary and explanatory and are not restrictive of the invention as claimed.

DESCRIPTION OF EMBODIMENTS

In the following, embodiments of the present invention are described with reference to the accompanying drawings.

<First Embodiment>

<Printer Apparatus>

Figure 1:
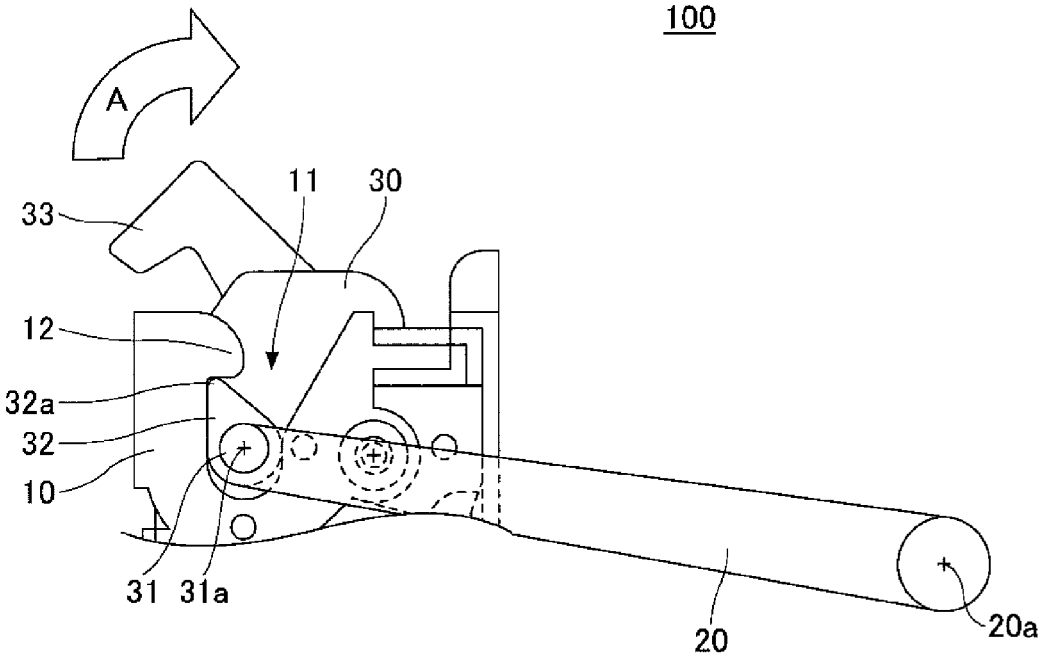
FIG. 1 is a schematic diagram illustrating a structure of a printer apparatus of a first embodiment.
Figure 2:
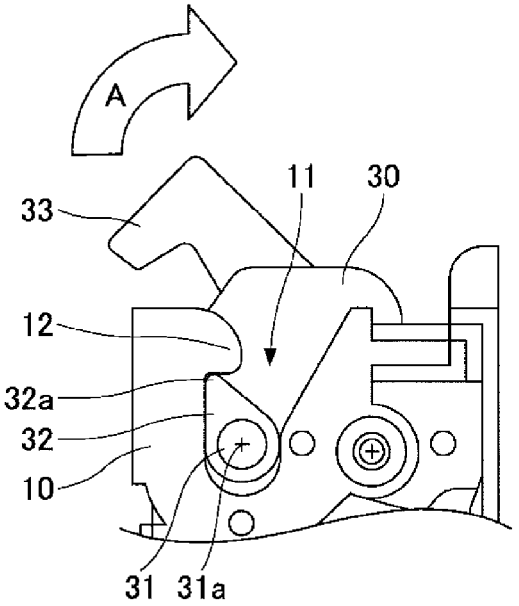
FIG. 2 is an enlarged view illustrating a portion of the structure of the printer apparatus of the first embodiment.

A printer apparatus 100 according to a first embodiment is described. FIG. 1 is a schematic diagram illustrating a structure of the printer apparatus 100 of the first embodiment. FIG. 2 is an enlarged view illustrating a portion of the structure of the printer apparatus 100 of FIG. 1.

As illustrated in FIGS. 1 and 2, the printer apparatus 100 includes a printer body 10 and a support part 20 rotatably attached to the printer body 10 to rotate about a rotation shaft 20*a*. A portion of the printer body 10 is omitted from the drawings. A cover is attached to the support part 20 and moves with the support part 20, but the cover is not illustrated in the drawings for the sake of convenience. As long as the support part 20 is provided in the printer apparatus 100, the printer apparatus 100 may be without the cover. FIGS. 1 and 2 illustrate a state where the cover of the printer apparatus 100 is closed and a state where printing can be performed on a recording paper.

Figure 3:
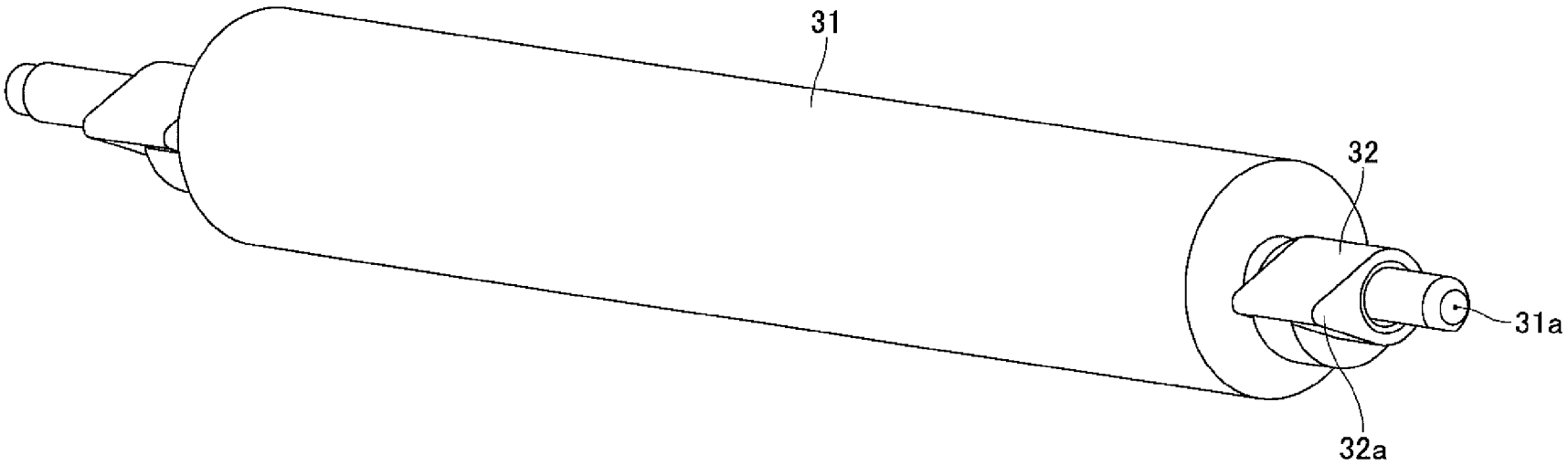
FIG. 3 is a perspective view illustrating a platen roller and a shaft bearing of the printer apparatus of the first embodiment.

A thermal head (not illustrated) is attached to the printer body 10. A platen unit 30 is attached to the support part 20. A platen roller 31 is rotatably attached to the platen unit 30 to rotate about a rotation shaft 31*a*. With reference to, for example, FIGS. 1-3, the platen roller 31 includes shaft bearings 32 provided at the vicinity of both ends of the platen roller 31. The shaft bearing 32 includes a projecting part 32*a* formed to be farther from a center of the rotation shaft 31*a* compared to other parts of the shaft bearing 32. An operation lever 33 for rotating the platen unit 30 about the rotation shaft

31*a* that is to be used when, for example, replacing a recording paper (not illustrated) is provided in the platen unit 30. The shaft bearing 32 is in a locked state when the shaft bearing 32 is placed and fixed in a substantially U-shaped opening 11 provided in a frame of the printer body 10. A protruding part 12 is provided in a vicinity of an inlet of the opening part 11, so that the shaft bearing 32 is locked in a state where the projecting part 32*a* abuts the protruding part 12. In this state, printing can be performed with the thermal head.

Figure 4:
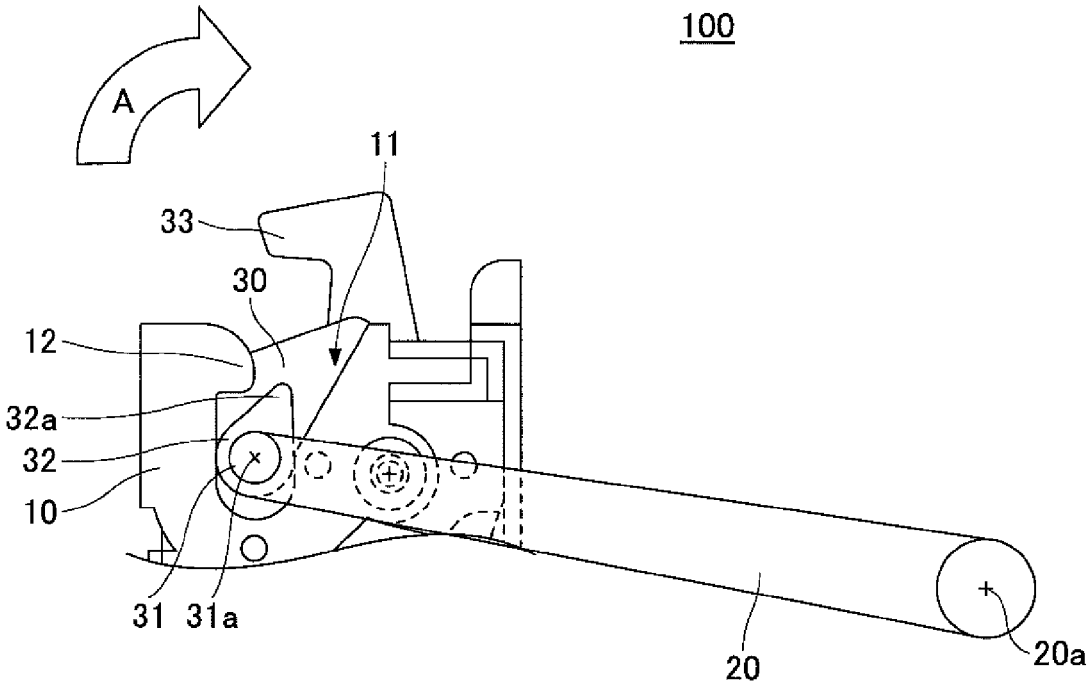
FIG. 4 is a schematic diagram illustrating the structure of the printer apparatus of the first embodiment.
Figure 5:
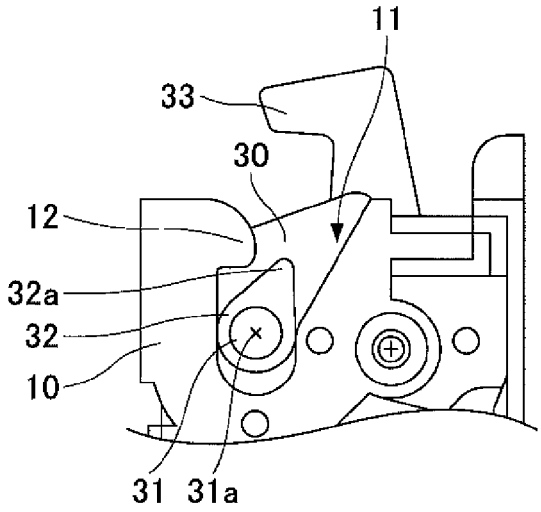
FIG. 5 is an enlarged view illustrating the portion of the structure of the printer apparatus of the first embodiment.

Next, an opening/closing movement of the printer apparatus 100 of the first embodiment is described. The opening/closing movement is performed in a case of, for example, replacing a recording paper. The opening/closing movement is performed by moving the operation lever 33 in an arrow direction "A" from the state illustrated in FIGS. 1 and 2. That is, the operation lever 33 is moved in a clockwise direction. By moving the operation lever 33 in the clockwise direction, the platen unit 30 and the shaft bearing 32 is rotated in direction "A" as illustrated in FIGS. 4 and 5 and the shaft bearing 32 is unlocked, and a locked state between the thermal head and the platen roller 31 is released.

Figure 6:
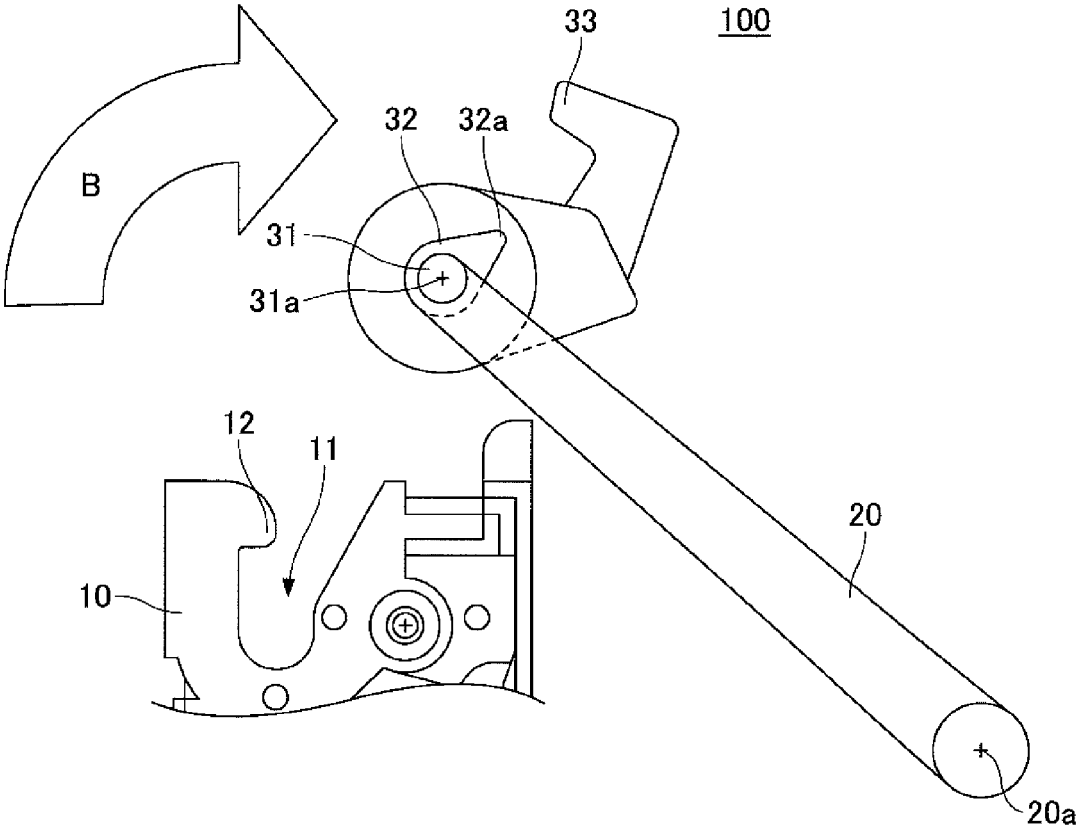
FIG. 6 is a schematic diagram illustrating the structure of the printer apparatus of the first embodiment.
Figure 7:
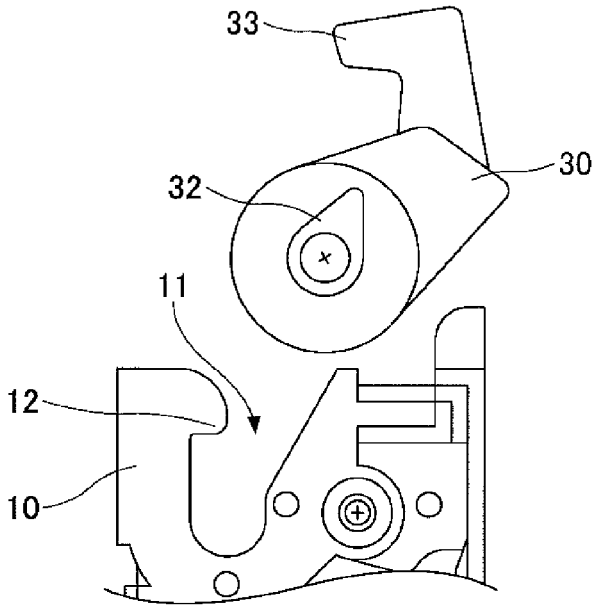
FIG. 7 is an enlarged view illustrating the portion of the structure of the printer apparatus of the first embodiment.

Then, as illustrated in FIGS. 6 and 7, the support part 20 is rotated in an arrow direction "B" about the rotation shaft 20*a* by moving the operation lever 33 in direction "B", and the support part 20 is rotated in a clockwise direction. By rotating the support part 20 in the clockwise direction, the shaft bearing 32 can be removed from the opening 11 of the frame of the printer body 10. Thereby, the platen unit 30 is separated from the printer body 10. The support part 20 can be moved in direction "B" by pulling the operation lever 33 up in direction "B" from the state illustrated in FIG. 4. In the state illustrated in FIGS. 6 and 7, a recording paper can be replaced.

In this embodiment, the operation of releasing the locked state of the platen roller 31 is performed by moving the operation lever 33 in the clockwise direction illustrated with arrow "A", and the operation of separating the platen unit 30 from the printer body 10 is performed by rotating the support part 20 about the rotation shaft 20*a* in the clockwise direction illustrated with arrow "B". Therefore, with the printer apparatus 100 of the first embodiment, an operation direction of releasing the locked state and an operation direction of separating the platen unit 30 from the printer body 10 are same, in the clockwise direction. Accordingly, the movement of releasing the locked state and the movement of separating the platen unit 30 from the printer body 10 can be continuously performed without pausing in-between. Thus, the opening/closing movement of the cover attached to the support part 20 can be easily performed. Alternatively, the movement of releasing the locked state and the movement of separating the platen unit 30 from the printer body 10 may be consecutively performed by exerting force on the operation lever 33.

Further, as illustrated in FIGS. 1 and 2, the platen roller 31 can be fixed to the printer body 10 by having the projecting part 32*a* abut the protruding part 12 of the frame of the printer body 10. Therefore, the support part 20 can be prevented from being moved by shock, vibration, or the like. Thus, the cover attached to the support part 20 can be prevented from accidentally opening.

With the printer apparatus 100 of the first embodiment, the direction of the movement is the same for both releasing the locked state and separating the platen unit 30 from the printer body 10. In contrast, if the operation of the operation lever when releasing the locked state and the operation of the operation lever when separating a platen unit from a printer body are performed in opposite directions, the rotation movement is to be switched between the movement of releasing the locked state and the movement of separating the platen unit from the printer body. Therefore, in this case, performing the operation of opening/closing the cover part is inconvenient.

Figure 8:
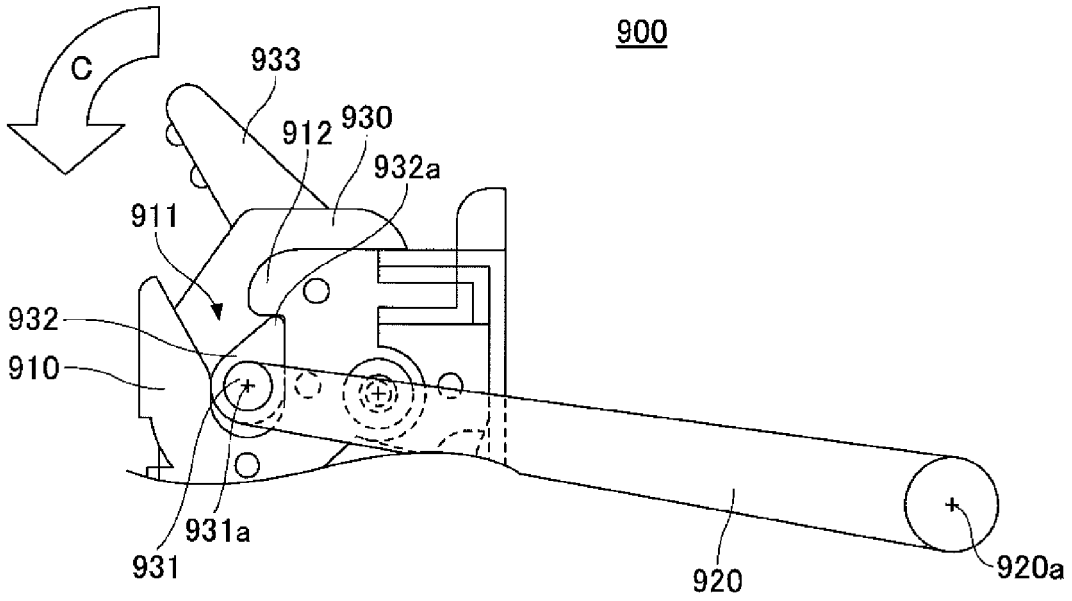
FIG. 8 is a schematic diagram for describing an opening/closing direction of another printer apparatus.

With reference to FIG. 8, a printer apparatus 900 includes a printer body 910 and a support part 920 rotatably attached to the printer body 910 to rotate about a rotation shaft 920*a*, similar to the printer apparatus illustrated in FIG. 1. A cover attached to the support part 920 is not illustrated.

A thermal head is attached to the printer body 910. A platen unit 930 is attached to the support part 920. A platen roller 931 is rotatably attached to the platen unit 930 to rotate about a rotation shaft 931*a*. Each of shaft bearings 932 provided at both ends of projecting from a center of the rotation shaft 931*a*. An operation lever 933 is provided in the platen unit 930. The shaft bearing 932 is locked when the shaft bearing 932 is placed and fixed in a substantially U-shaped opening part 911 provided in a frame of the printer body 910. A protruding part 912 is provided in a vicinity of an inlet of the opening part 911, so that the shaft bearing 932 is locked when the projecting part 932*a* abuts the protruding part 912.

Figure 9:
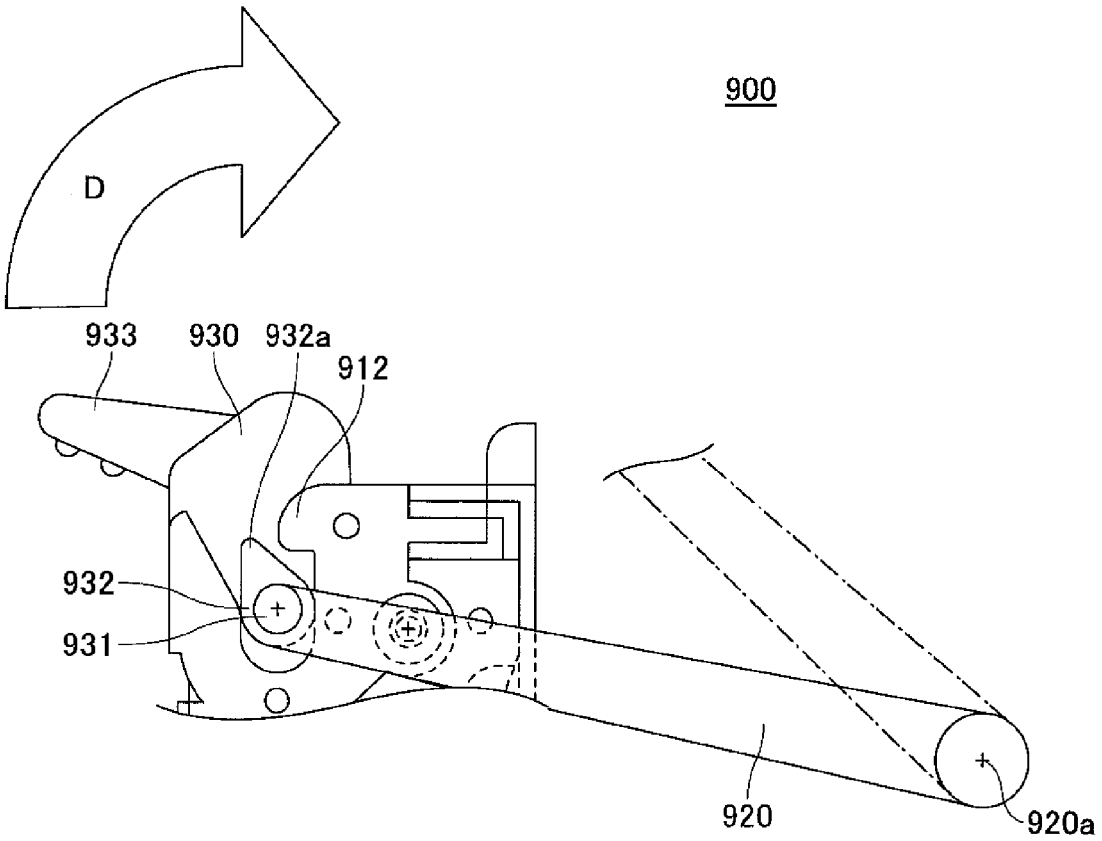
FIG. 9 is a schematic diagram for describing the opening/closing direction of the other printer apparatus.

For example, in a case of lifting the support part 920 for opening the cover with the printer apparatus 900 illustrated in FIG. 8, the operation lever 933 is to be moved in an arrow direction "C" (i.e. counter-clockwise direction) for releasing the locked shaft bearing 932. By moving the operation lever 933 in the counter-clockwise direction, the protruding part 912 of the frame of the printer body 910 and the projecting part 932*a* are separated from each other as illustrated in FIG. 9. Thereby, the locked state between the thermal head and the platen roller 931 is released. After the movement of the operation lever is stopped as the projecting part 932*a* is unlocked, the platen unit 930 is removed from the printer body 910 by rotating the support part 920 about the rotation shaft 920*a* in an arrow direction "D" (i.e. clockwise direction). In this case, the movement of releasing the locked state and the movement of removing the platen unit 930 from the printer body 910 are oriented in different directions. Therefore, it is necessary to switch directions of the movement after releasing the locked state by moving the operation lever 933 when performing the movement of separating the platen unit 930 from the printer body 910. Therefore, in this case, performing the operation of opening/closing the cover part is time consuming and inconvenient.

As described above, in FIG. 8, the shaft bearing 932 is released by moving the operation lever 933 in the counter-clockwise direction. Thus, if force is accidentally exerted on the operation lever 933 in the clockwise direction during separating the platen unit 930 from the printer body 910, the shaft bearing 932 may return to the locked state. Accordingly, when separating the platen unit 930 from the printer body 910, the support part 920 is to be moved by exerting force on a part other than the operation lever 933. Therefore, performing the operation of opening/closing the cover part with the printer apparatus 900 illustrated in FIG. 8 is time consuming and inconvenient.

Because these problems do not occur with the printer apparatus 100 of the first embodiment, the printer apparatus 100 can smoothly perform the operation of opening/closing the cover part without encountering any inconvenience. In FIGS. 1-7, the movement of releasing the locked state and the movement of separating the platen unit 30 from the printer body 10 are both performed in a clockwise direction. However, as long as the directions of the movement of releasing the locked state and the movement of separating the platen unit 30 from the printer body 10 are the same, the movement of releasing the locked state and the movement of separating the platen unit 30 from the printer body 10 may both be performed in a counter-clockwise direction.

<Second Embodiment>

Figure 10:
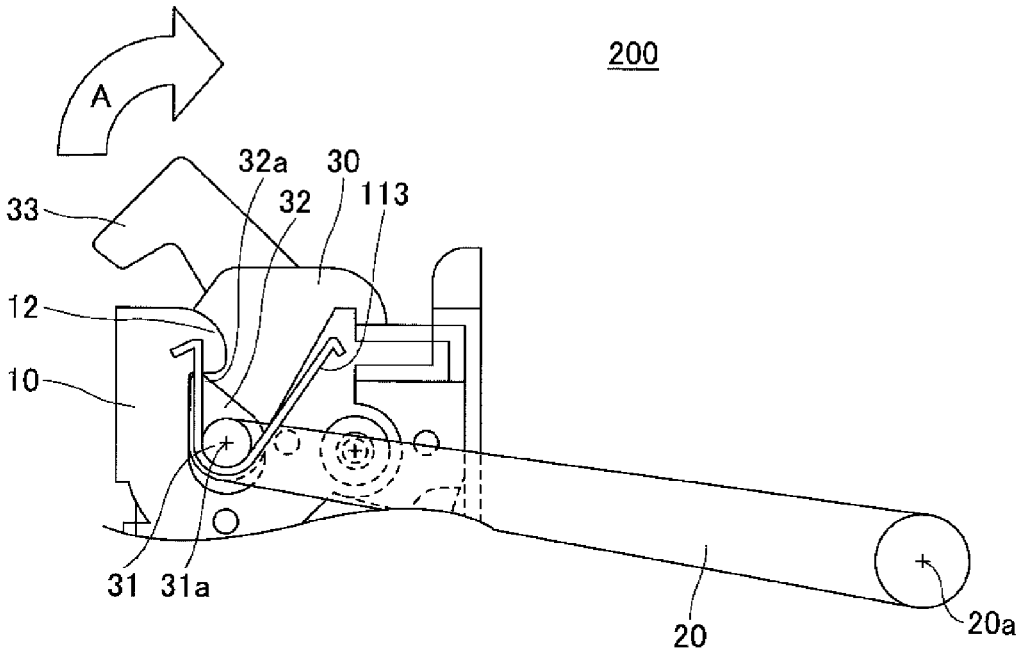
FIG. 10 is a schematic diagram illustrating a structure of a printer apparatus of a second embodiment.

Next, a printer apparatus 200 according to a second embodiment is described. It is to be noted that like components are denoted by like reference numerals as the reference numerals of the first embodiment and are not further explained. As illustrated in FIG. 10, the printer apparatus 200 includes a spring 113 provided in the printer body 10. The spring 113 exerts a bias force that causes the shaft bearing 32 to move outward from the opening part 11 (upward direction in FIG. 10). Therefore, in a case of releasing the locked platen unit 30 by releasing the contact between projecting part 12 of the frame of the printer body 10 and the protruding part 32*a* of the shaft bearing 32 of the platen roller 31, the bias force exerted by the spring 113 causes the shaft bearing 32 to move outward from the opening part 11. Thereby, separating the platen unit 30 from the printer body 10 can be smoothly performed. It is to be noted that the configuration of the printer apparatus 200 of the second embodiment is the substantially the same as the printer apparatus 100 of the first embodiment except for the spring 113 provided in the printer body 10.

<Third Embodiment>

Figure 11:
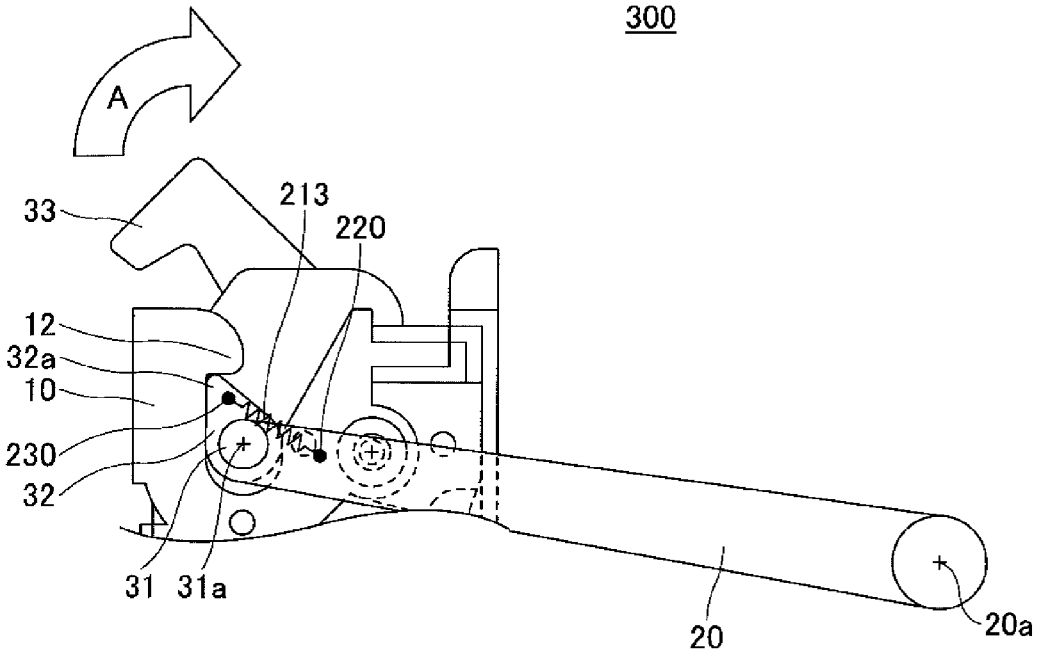
FIG. 11 is a schematic diagram illustrating a structure of a printer apparatus of a third embodiment.

Next, a printer apparatus 300 according to a third embodiment is described. It is to be noted that like components are denoted by like reference numerals as the reference numerals of the first embodiment and are not further explained. As illustrated in FIG. 11, the printer apparatus 300 includes a spring such as a coil spring 213 provided between the support part 20 and the shaft bearing 32. One end part of the coil spring 213 is connected to a connection part 230 provided in a vicinity of the projecting part 32*a* of the shaft bearing 32. The other end part of the coil spring 213 is connected to a connection part 220 provided in the support part 20. FIG. 11 illustrates a state where a bias force is exerted in a direction that causes the coil spring 213 to expand. In other words, a restoring force is exerted in a direction that causes the coil spring 213 to expand. Thereby, the expanding force of the coil spring 213 makes releasing of the locked state more difficult. Accordingly, the cover can be prevented from being opened due to shock, vibration or the like.

The above-described embodiment provides a printer apparatus having a simple structure and including a cover part that can be easily opened/closed by the user. The cover part, however, cannot be easily opened by shock, vibration or the like.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

The invention claimed is:

1. A printer apparatus comprising:

a printer body including an opening part that forms a protruding part;

a platen unit removably installed in the printer body; and an operation lever rotatably provided in the platen unit;

a platen roller including a first rotary shaft and rotatably provided in the platen unit to rotate about the first rotary shaft;

a shaft bearing that rotatably supports the platen roller and configured to rotate about the first rotary shaft in accordance with a rotation of the operation lever, the shaft bearing including a projecting part formed to be farther from the first rotary shaft compared to other parts of the shaft bearing; and a support part provided in the printer body by way of a second rotary shaft and configured to rotatably support the platen unit to rotate about the second rotary shaft;

wherein the opening part is configured to receive the shaft bearing, wherein when the platen unit is installed in the printer body, the projecting part and the protruding part contact each other, and wherein a direction in which the projecting part rotates about the first rotary shaft when the contact between the projecting part and the protruding part is released by way of the rotation of the operation lever is the same as a direction in which the platen unit rotates about the second rotary shaft when removing the platen unit from the printer body.

2. The printer apparatus as claimed in claim 1, wherein the contact between the projecting part and the protruding part is released by operating the operation lever in a first direction, wherein the platen unit can be removed from the printer body by moving the operation lever in the first direction.

3. The printer apparatus as claimed in claim 1, further comprising:

wherein the printer body further includes a spring, wherein when the projecting part and the protruding part contact each other, the spring is configured to exert a force on the shaft bearing in a direction causing the shaft bearing to move outward from the opening part.

4. The printer apparatus as claimed in claim 1, wherein the printer body further includes a spring provided between the projecting part and the support part, wherein the spring generates a restoring force by having one end of the spring connected to a connection part provided in a vicinity of the projecting part and another end of the spring connected to a connection part provided in the support part, wherein when the projecting part and the protruding part contact each other, the restoring force of the spring exerts a force in a direction in which the spring expands.

5. The printer apparatus as claimed in claim 1, wherein the projecting part projects from the shaft bearing in a radial direction of the second rotary shaft.

6. The printer apparatus as claimed in claim 1, wherein the projecting part has a tapered cross section that becomes narrower the farther away from the second rotary shaft.

7. A method for operating a printer apparatus that includes a printer body including an opening part that forms a protruding part, a platen unit removably installed in the printer body, an operation lever rotatably provided in the platen unit, a platen roller including a first rotary shaft and rotatably provided in the platen unit to rotate about the first rotary shaft, and a shaft bearing that rotatably supports the platen roller and configured to rotate about the first rotary shaft in accordance with a rotation of the operation lever, the shaft bearing including a projecting part formed to be farther from the first rotary shaft compared to other parts of the shaft bearing, a support part provided in the printer body by way of a second rotary shaft and configured to rotatably support the platen unit to rotate about the second rotary shaft, the opening part receiving the shaft bearing, the projecting part and the protruding part contacting each other when the platen unit is installed in the printer body, the method comprising:

releasing the projecting part contacting with the protruding part by rotating the shaft bearing in a first direction; and removing the platen unit from the printer body by rotating the support part in the first direction after the projecting part, wherein a direction in which the projecting part rotates about the first rotary shaft when the contact between the projecting part and the protruding part is released by way of the rotation of the operation lever is the same as a direction in which the platen unit rotates about the second rotary shaft when removing the platen unit from the printer body.

8. The method as claimed in claim 7, wherein the releasing of the contacting state and the removing of the platen unit are both performed by exerting force on the operation lever.

* * * * *